United States Patent [19]

Wohlfeil

[11] Patent Number: 4,706,603

[45] Date of Patent: Nov. 17, 1987

[54] COATING APPARATUS WITH EDGE PROTECTION FOR PAPER WEBS

[75] Inventor: Gerhard Wohlfeil, Monheim, Fed. Rep. of Germany

[73] Assignee: Jagenberg Aktiengesellschaft, Dusseldorf, Fed. Rep. of Germany

[21] Appl. No.: 847,432

[22] Filed: Apr. 2, 1986

[30] Foreign Application Priority Data

Apr. 12, 1985 [DE] Fed. Rep. of Germany ..... 3513063

[51] Int. Cl.[4] ..... B05C 5/02

[52] U.S. Cl. ..... 118/410; 118/413; 118/419

[58] Field of Search ..... 118/410, 413, 419, 407

[56] References Cited

U.S. PATENT DOCUMENTS 3,273,535 9/1966 Krikorain ..... 118/413 X 4,250,211 2/1981 Damrau et al. ..... 118/413 X 4,398,494 8/1983 Alheid ..... 118/413 X

FOREIGN PATENT DOCUMENTS 3300612 8/1983 Fed. Rep. of Germany .

3336552 7/1984 Fed. Rep. of Germany .

*Primary Examiner*—John P. McIntosh

*Attorney, Agent, or Firm*—Karl F. Ross; Herbert Dubno

[57] ABSTRACT

A coating apparatus for fabric webs carried along a counter roll includes an applicator which accomodates a chamber containing coating color to be applied onto the fabric web. The chamber is defined by spaced doctor blade and overflow plate and dam elements laterally sealing the chamber. For preventing a coating of the web along its edges, separate doctor assemblies are provided which are controlled independently of the dam plates.

12 Claims, 8 Drawing Figures

FIG.4
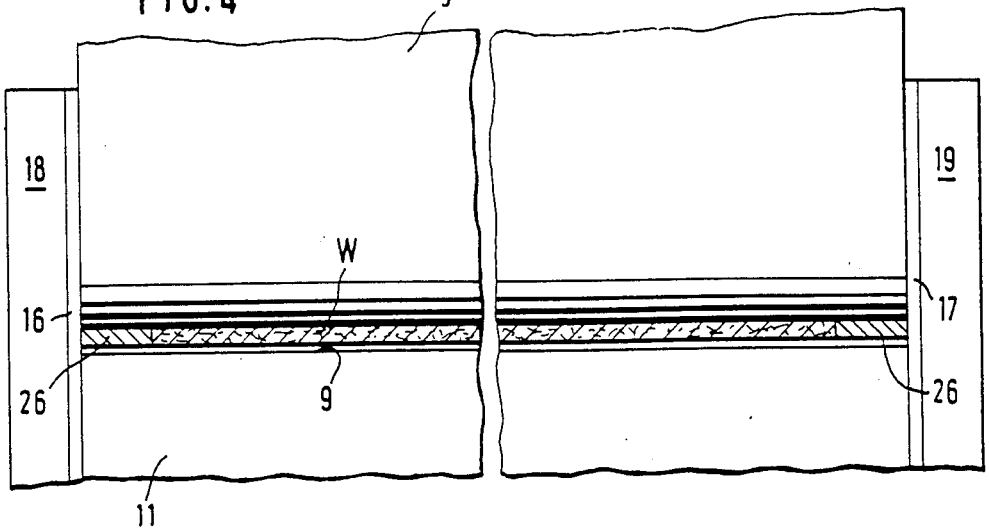
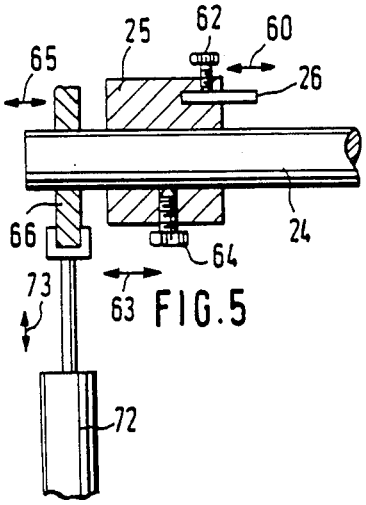
FIG.5
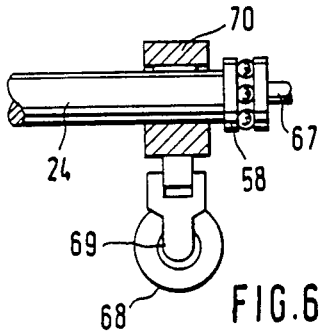
FIG.6
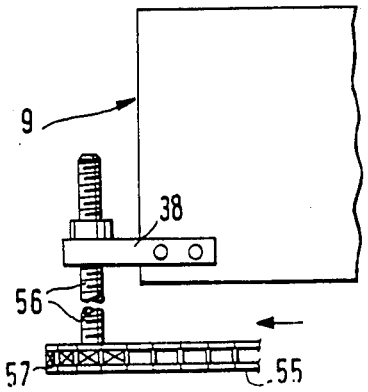
FIG.7
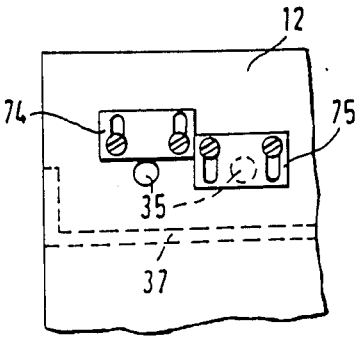
FIG.8

COATING APPARATUS WITH EDGE PROTECTION FOR PAPER WEBS

FIELD OF THE INVENTION

My present invention relates to an apparatus for coating a flexible web and, more particularly, to the coating of a paper web so that the edges thereof remain, free of the coating material.

BACKGROUND OF THE INVENTION

U.S. Pat. No. 4,250,211 describes a paper coating apparatus having an applicator cooperating with a counter roll about which the paper is guided.

The applicator includes a main beam whose front side supports a rear wall which is mounted adjacent to and spaced from a front wall so as to define a chamber converging towards the roll. A doctor blade extends from the rear wall and engages the web to hold back excess coating material. At a distance from the blade is an orifice plate which is adjustably mounted on the front wall to be movable toward and away from the counter roll. To close and seal the chamber at its sides, end plates are provided engaging sealing ledges secured to the side of the applicator.

These lateral end plates are, however, not only provided to enclose the chamber in order to prevent leakage of coating color contained in the chamber, but also to limit the application of coating to a desired width of the web, i.e. to prevent a coating of the paper web along its edges. As practice has shown, this is disadvantageous as especially when changing the adjustment of the applicator, e.g. upon angular adjustments, the end plates move with the blade or blades and cannot guarantee proper sealing of the coating material chamber and at the same time present coating of the edges of the paper web and leakage past these edges.

OBJECTS OF THE INVENTION

It is thus the principal object of my present invention to provide an improved coating apparatus obviating the afore-stated drawbacks.

Another object is to provide an apparatus which can be used to coat a paper web but which ensures proper lateral or end sealing of the coating material chamber and at the same time ensures clean edges, i.e. edges free of the coating.

SUMMARY OF THE INVENTION

I realize this object in accordance with the present invention by providing separate edge doctor blades projecting into a chamber which is defined by spaced doctor blade and overflow plate and a pair of dam elements tightly engaging or hugging the roll and the overflow plate for laterally closing the chamber and preventing leakage.

According to the invention, the coating of the paper web along its edges is prevented through the provision of separate doctor blades, while the dam elements are only used to guarantee a lateral sealing of the chamber. Preferably, each dam element comprises a polygonal plate which at its inside facing the counter roll and overflow plate is provided with a sealing and at its outside is fixed to a bearing. The dam plates are so dimensioned that they continuously lie tightly against the counter roll and the overflow plate even at substantial angular adjustments or the like.

According to a further feature of the invention, each doctor assembly includes a holder which is supported on a rotating bearing shaft extending parallel to the axis of the counter roll, and a blade or bar which extends essentially transversely to the bearing shaft and is adjustable in longitudinal direction. Thus the doctor assembly can be adjusted without any interference with the sealing and damming as provided by the dam elements at the counter roll and the overflow plate.

In order to allow an adjustment of each doctor assembly in all directions, the holder is displaceable in direction towards the counter roll and the bearing shaft is shiftable in axial direction. Thus the doctor assembly can be adjusted to varying web widths even during operation by displacing the bearing axis in axial direction.

Preferably the overflow plate is provided with height adjustable sliders in the area of the dam elements in order to allow a controlled pressure reduction so that the pressure exerted by the coating color on the dam elements can be relieved. This pressure relief can alternatively be obtained also by providing the overflow plate with aligned through-holes below the overflow gap defined between the overflow plate and the counter roll. When providing the through-holes along the entire width of the overflow plate and connecting them with suitable closing means, the overflow gap may be omitted so that the overflow of the coating color is provided through the through-holes which are arranged below the fluid level.

Advantageously, the overflow plate is supported and continuously adjusted by respective cylinder-piston units to keep constant the width of the originally set overflow gap.

BRIEF DESCRIPTION OF THE DRAWING

The above and other objects, features and advantages of my present invention will become more readily apparent from the following description, reference being made to the accompanying highly diagrammatic drawing in which:

FIG. 4 is a vertical section through the blades of the doctor assembly showing associated parts in elevation;

FIG. 5 is a detail showing how the edge-protector blade is mounted on the shaft, partly in section;

FIG. 6 is a detail showing the means for adjusting the latter shaft;

FIG. 7 is an elevation diagrammatically showing another mechanism for adjusting the height of the upstream blade; and FIG. 8 is a detail, partly in section, showing the means for selectively blocking off portions of the coating material escape passages in the upstream blade.

SPECIFIC DESCRIPTION

Figure 1:
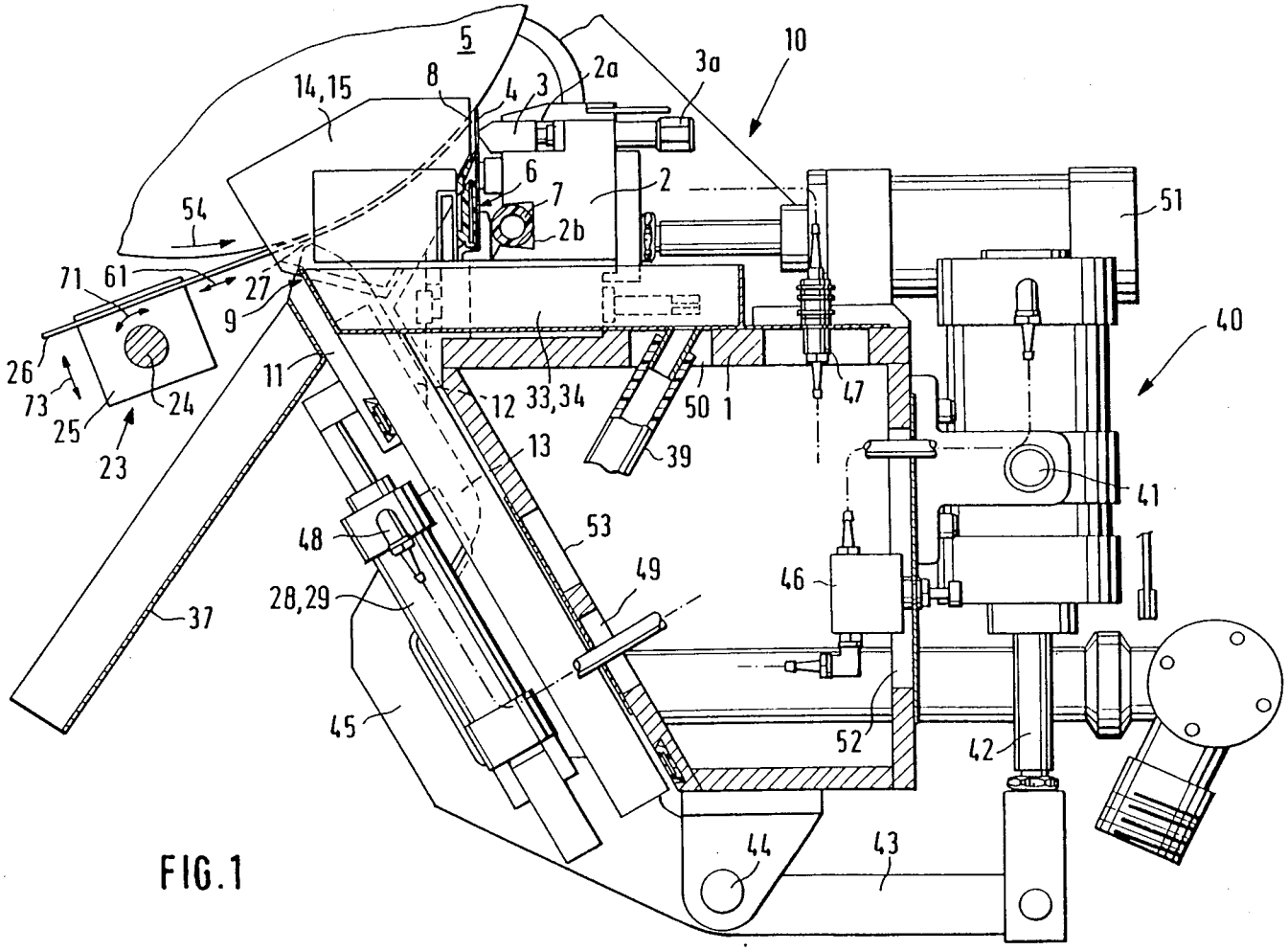
FIG. 1 is a fragmentary side view of a first embodiment of a coating apparatus according to the invention partly broken away.
Figure 2:
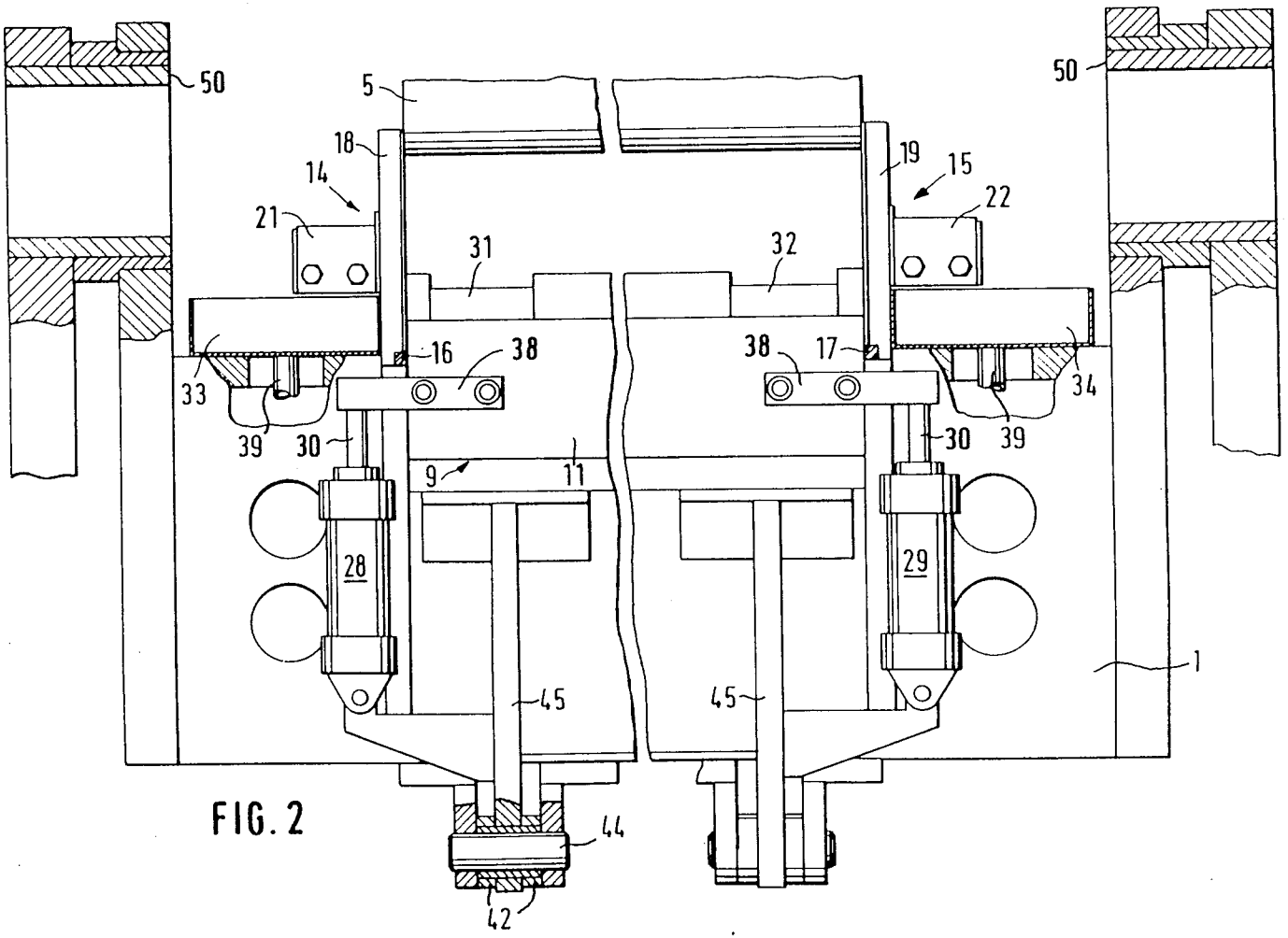
FIG. 2 is a front view of the coating apparatus of FIG. 1 partly broken away.

FIGS. 1 and 2 show a first embodiment of a coating apparatus according to the invention and including an applicator generally designated by reference numeral 10 and cooperating with a counter roll 5 which carries a paper web or the like to be coated with a suitable coating material. This web is shown at W in FIG. 4.

The applicator 10 includes a main frame 1 which is positioned relative to the counter roll 5 by suitable means, e.g. journals 50, and appropriate hydraulic or pneumatic cylinders (not shown).

The main frame 1 supports a bearing block 2 which is provided with a slot *2a* open toward the roll 5.

A backing element 3 is slidable in this slot and has its tip projecting beyond the front of the bearing block 2 to abut against a downstream doctor blade 4. The backing element 3 is adjustable in axial direction by a spindle *3a* which extends rearwardly beyond the back of the bearing block 2 to be accessible for controlling the projection thereof towards the doctor blade 4.

The block 2 can be moved toward and away from the roll 5 by a pair of fluid cylinders 51 (one shown in FIG. 1) mounted on the frame 1 which also carries a fluid cylinder 40 articulated to the frame 1 at 41. The piston 42 of this cylinder is pivotally connected to a lever 43 which is fulcrummed at 44 on the frame 1 to permit a framework 45 carrying the cylinders 28, 29 and assembly forming the upstream doctor blade 9 to be swung to bring this doctor blade closer to the blade 4 or further away from the latter. Various fittings communicating with the cylinders are shown at 46, 47, 48 and openings 49, 52, 53 are provided in the frame 1 to accomodate the various ducts.

The blade 4 rests on the paper web and thus on the counter roll 5 and holds back any surplus of coating color. The lower end of the blade 4 is fixed in a mounting 6 which includes a pressure tubing 7 accomodated in a recess *2b* of the bearing block 2.

Spaced from the blade 4 which is relatively downstream in the direction of rotation of roll 5 (arrow 54) is the overflow plate or upstream blade 9 which extends over the width of the counter roll 5 with its tip facing the latter to define an overflow gap 27 therewith.

The overflow plate 9 includes a pair of L-shaped slab elements 11, 12 connected to each other such that the overflow plate 9 is of inverted U-shaped cross-section.

Extending within the formed space between the shanks of the slab elements 11, 12 is a guide bar 13 along which the overflow plate 9 is movable towards and away from the counter roll 5.

Acting on the overflow plate 9 are the pneumatic cylinder-piston units 28, 29, whose pistons 30 are connected to the element 11 via clamps 38. The units 28, 29 are fastened to the main beam 1 and are operated with compressed air which is suitably connected to an air source (not shown) as indicated by a respective dash-dot line.

It should be pointed out that the adjustment of the overflow plate 9 can also be provided by alternative means such as through linkage of, e.g., the angular adjustment of the applicator 10 with the height adjustment of the overflow plate 9 by means of a chain drive 55 and appropriate universal-joint shafts and by replacing the cylinder-piston units 28, 29 by respective threaded spindle 56 sprockets 57 are engaged by the chain drive 55 and form lifters for the unit 9.

By continuously adjusting the overflow plate 9 with respect to the counter roll 5, the dimension of the gap 27 is kept constant during all adjustments of the applicator 20, e.g., angular adjustments.

As is shown in FIG. 1 and, in particular, in FIG. 3 which refers to a second embodiment of an applicator to be described in more detail further below, the doctor blade 4 and the overflow plate 9 define the forward and rearward end of a chamber 8 whose sides (lateral ends) are closed and sealed by respective dams 14, 15 which prevent a leaking of coating color or material from the chamber 8. The dams 14, 15 include two polygonal plates 18, 19 spaced from each other along the width of the counter roll 5 and fixed at their outside to brackets 21, 22.

The upper portion of each plate 18, 19 tightly lies against and hugs the counter roll 5 while the lower portions similarly hug the overflow plate 9. At their inside facing the overflow plate 9, the plates 18, 19 accomodate a sealing 16, 17. The plates 18, 19 are provided in such a manner that angular adjustments or the like of the applicator 10 do not effect the sealing or damming effect.

As is shown in particular in FIG. 2, the overflow plate 9 accomodates in vicinity of the dams 14, 15 sliders 31, 32 which are adjustable with respect to their height to provide a controlled pressure reduction in the area of the dams 14, 15 so that leakages are essentially prevented. In case leakage does, however, occur, the coating color is collected in respective troughs 33, 34 extending in vicinity of the dams 14, 15. The coating color collected in the troughs 33, 34 is discharged via pipe 39.

For preventing a coating of the paper web along its edges, a plurality of doctor assemblies or scrapers 23 (only one is ilustrated in FIG. 1) are provided which are adjustable independently of the dams 14, 15. Each doctor assembly 23 includes a holder 25 supported on a rotating bearing shaft 24 which extends parallel to the axis (not shown) of the counter roll 5.

Traversing the counter roll 5 and extending beyond the overflow plate 9 into the chamber 8 is a blade or bar 26 which essentially extends transversely to the shaft 24 as indicated by arrow 61 and is adjustable in longitudinal direction thereof. The holder 25 is displaceable in direction towards the counter roll 5 along the bearing shaft 24 which itself is adjustable in axial direction. Thus each doctor assembly 23 is accurately controllable in all directions so as to be adjustable to varying web widths and/or angular modifications, etc..

As can be seen from FIG. 5, for example, each blade 26 (see also FIG. 4) can be adjusted in a direction 60 parallel to the axis of the shaft 24 and in the direction 61 by release of the screw 62 and retightening thereof to lock the blade 26 in place. The holder 25 can be adjusted in the axial direction as represented by arrow 63 by release and retightening of setscrew 64. The shaft 24 itself is mounted to be axially movable (arrow 65) in its support 66 and the means for effecting axial movement of the shaft is a fluid cylinder whose piston 67 bears via a thrust bearing 58 upon an end of the shaft 24 (See FIG. 6). The angular displacement (arrow 71) of this shaft is effected by a cylinder 68 whose piston 69 is linked pivotally to a hub 70 splined to the shaft 24. The supports 66 for the shaft (of which only one support has been shown) can themselves be raised and lowered by cylinders of which one can be seen at 72 in FIG. 5 to effect displacement represented by the arrow 73 in FIGS. 1 and 5.

Figure 3:
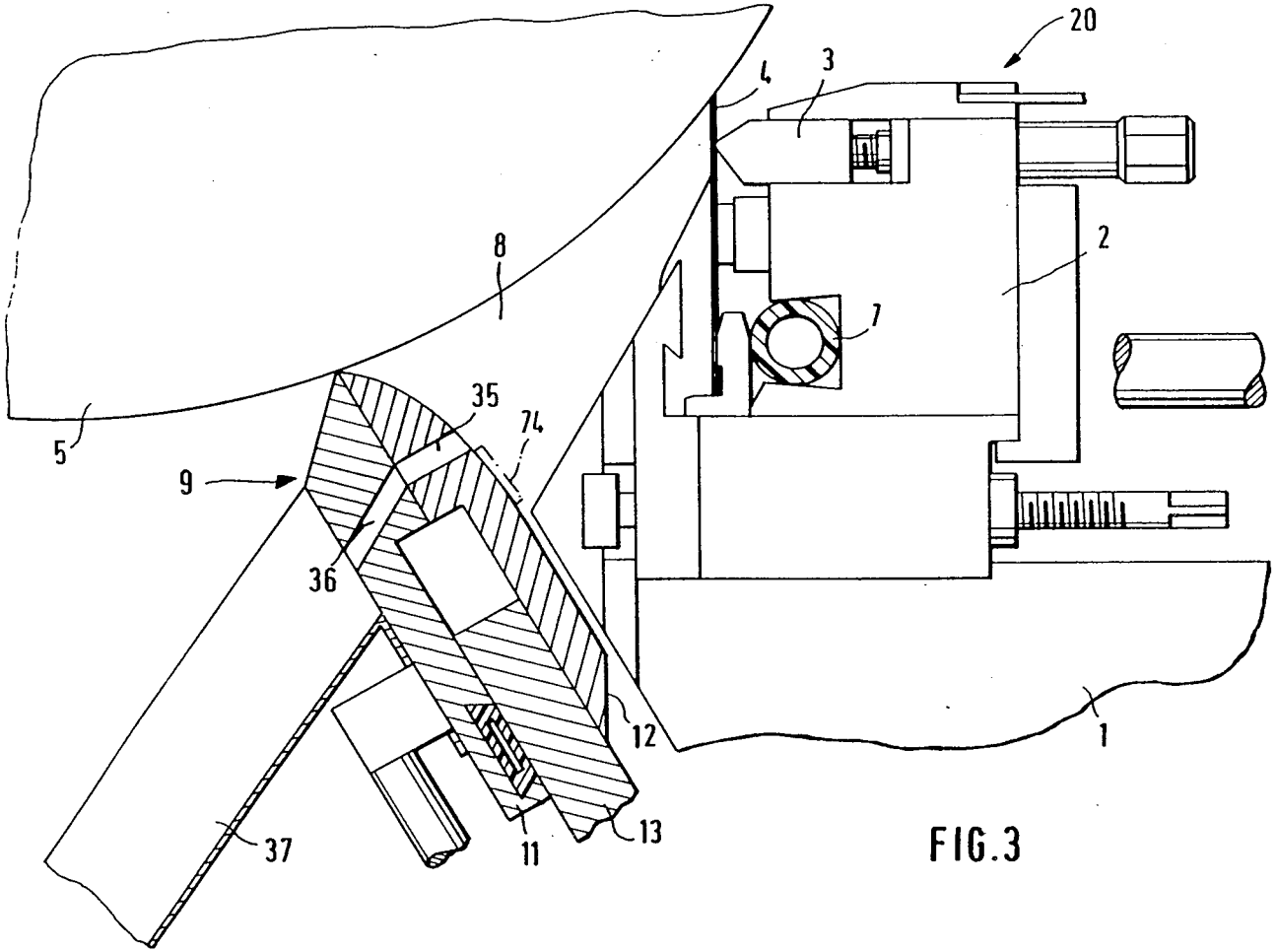
FIG. 3 is a fragmentary side view with parts in section of a modification of the coating apparatus according to the invention.

In FIG. 3, a second embodiment of an applicator according to the invention is shown which is designated by reference numeral 20 and essentially corresponds to the embodiment as illustrated in FIGS. 1 and 2. The only difference resides in the fact that the overflow plate 9 extends in immediate proximity of the counter roll 5, i.e. the web carried by the counter roll 5 thus preventing the formation of an overflow gap 27 as illustrated in FIG. 1. In order to provide the necessary overflow of the coating material, the slab element 12 of the overflow plate 9 accomodates a through-hole 35 which communicates with the chamber 8 and is aligned with a through-hole 36 provided within the element 11 and communicating with a drain conduit 37. The through-holes 35, 36 may extend over the entire width of the overflow plate 9 and can—if necessary—be closable by suitable means, e.g. the plates 74, 75 seen in FIG. 8. The through-holes 35, 36 can also be used to decrease the pressure within the chamber 8 instead of providing the sliders 31, 32 as illustrated in FIG. 2 whereby the overflow plate 9 and the counter roll 5 define an overflow gap 27 therebetween.

I claim:

1. An apparatus for coating a web carried along a roll, comprising:

a doctor blade cooperating with said roll;

an overflow plate spaced from said blade so as to define a chamber therebetween for accomodating a coating material;

dam elements closing said chamber at its sides flanking said roll and tightly arranged against axially opposite ends of said overflow plate and said roll; and adjustable edge blade means for preventing a coating of the web along its edges, said edge blade means being positioned along said edges adjacent said dam elements.

2. The apparatus defined in claim 1, further comprising sealing means, each of said dam plates including a polygonal plate whose inside faces said overflow plate and said roll and accomodates said sealing means, and a bracket fixed to the outside of said plate.

3. The apparatus defined in claim 1 wherein said adjustable edge blade means include at least one doctor assembly provided with a rotating bearing shaft extending parallel to the axis of said roll, a holder supported on said shaft and an edge protecting blade mounted in said holder and adjustable substantially transversely to said shaft in a longitudinal direction of said edge protecting blade.

4. The apparatus defined in claim 3 wherein said holder is displaceable along said shaft towards and away from said roll and said shaft is adjustable in axial direction thereof.

5. The apparatus defined in claim 1, further comprising height adjustable sliders arranged in said overflow plate in a vicinity of said dam elements.

6. The apparatus defined in claim 1, further comprising control means for supporting and continuously adjusting said overflow plate.

7. The apparatus defined in claim 6 wherein said control means includes pneumatic cylinder-piston units acting on each axial end of said overflow plate.

8. The apparatus defined in claim 6 wherein said control means includes spindle lifting elements acting on said overflow plate.

9. The apparatus defined in claim 6 wherein said overflow plate is of U-shape and provided by a pair of L-shaped slab elements connected to each other so as to define an internal space.

10. The apparatus as defined in claim 9, further comprising a guide bar extending within said internal space, said overflow plate being movable along said guide bar by said control means.

11. An apparatus for coating a web carried along a roll, comprising:

a doctor blade cooperating with said roll;

an overflow plate spaced from said blade so as to define a chamber therebetween for accomodating a coating material;

dam elements closing said chamber at its sides flanking said roll and tightly arranged against axially opposite ends of said overflow plate and said roll;

adjustable edge blade means for preventing a coating of the web along its edges, said edge blade means being positioned along said edges adjacent of said dam elements; and said overflow plate being provided with aligned through-holes communicating with said chamber.

12. The appartus defined in claim 11 whenever said through-holes extend over the entire width of said overflow plate, and further comprising means for closing said through-holes.

* * * * *